United States Patent [19]

Simmons

[11] 4,114,395

[45] Sep. 19, 1978

[54] INTEGRATED REFRIGERANT STORAGE CANISTER AND HEAT EXCHANGER

[75] Inventor: Carl E. Simmons, Oxford, Ohio

[73] Assignee: United Aircraft Products, Inc., Dayton, Ohio

[21] Appl. No.: 753,738

[22] Filed: Dec. 23, 1976

[51] Int. Cl.[2] ..... B67D 5/62

[52] U.S. Cl. ..... 62/386; 62/400; 165/169

[58] Field of Search ..... 62/384, 386, 400; 165/169

[56] References Cited

U.S. PATENT DOCUMENTS

| | | | |
|---|---|---|---|
| 848,228 | 3/1907 | Ettel | 62/400 |
| 939,021 | 11/1909 | Hendrix | 62/400 |
| 3,475,922 | 11/1969 | Scott et al. | 165/169 |
| 3,788,091 | 1/1974 | Miller | 62/384 |

*Primary Examiner*—Ronald C. Capossela
*Attorney, Agent, or Firm*—J. E. Beringer

[57] ABSTRACT

A heat exchanger-canister combination, the canister being used to hold a solid state refrigerant absorbing heat from a circulating fluid heated at a relatively remote source, the walls of the canister being used to transfer heat into the contained refrigerant.

10 Claims, 12 Drawing Figures

FIG-6
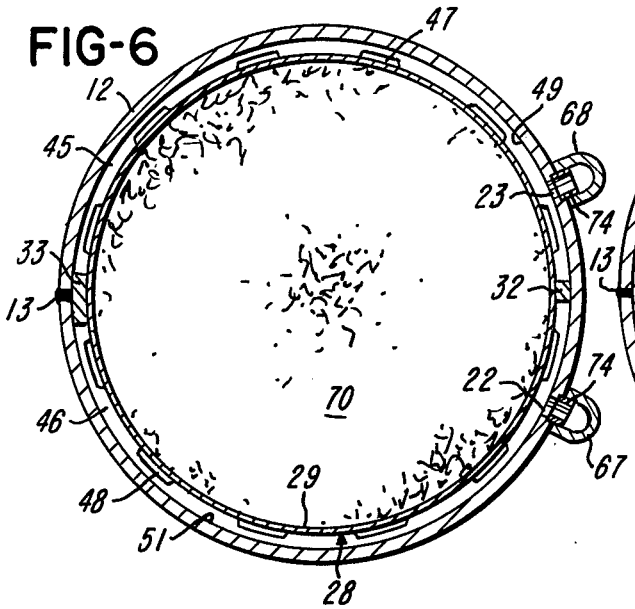
FIG-7
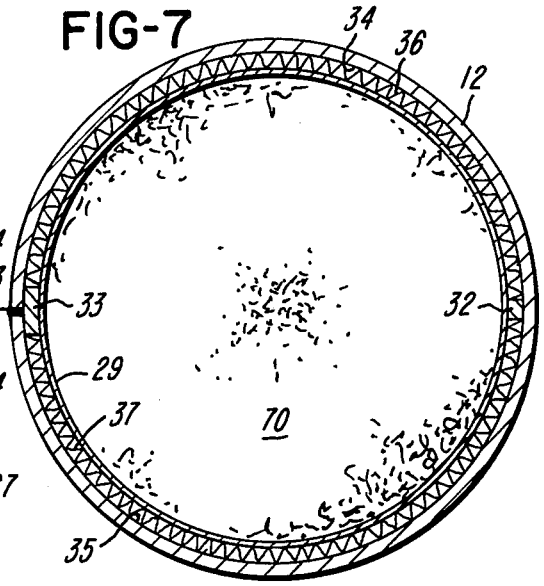
FIG-8
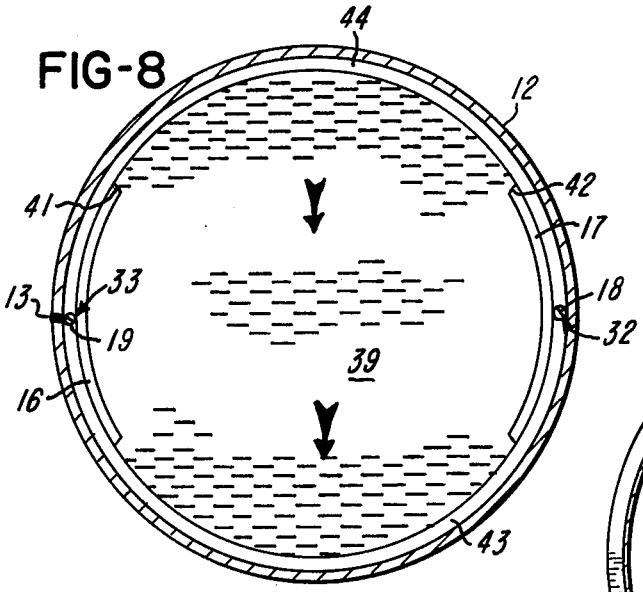
FIG-9
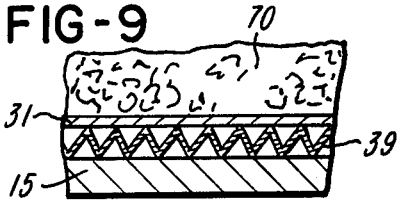
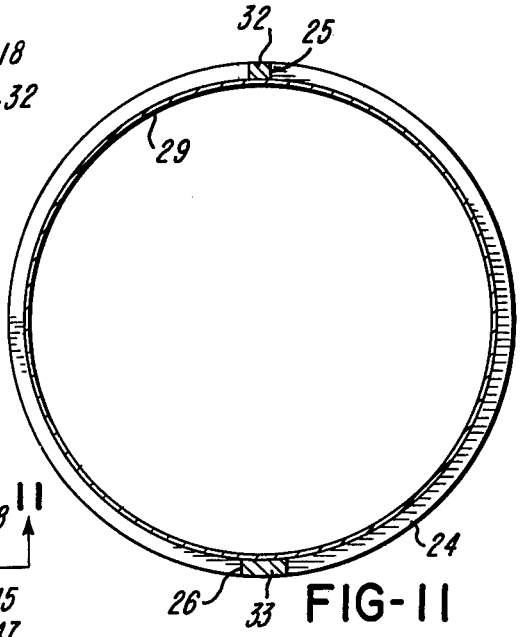
FIG-11
FIG-10
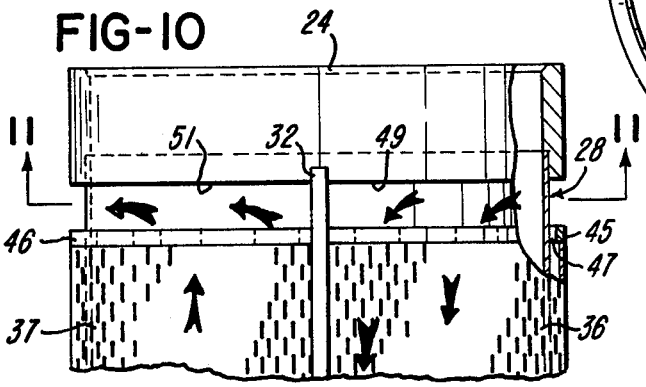
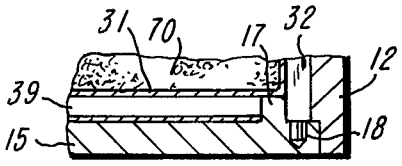
FIG-12

INTEGRATED REFRIGERANT STORAGE CANISTER AND HEAT EXCHANGER

BACKGROUND OF THE INVENTION

This invention relates to a heat exchanger-canister combination and particularly to a device of this class introducing concepts of weight reduction and high performance into its structure and heat transfer capabilities.

In the prior art, it has been suggested that a canister holding a solid state refrigerant such as "dry ice", could be used in a portable cooling system, as for example in a system flowing a liquid coolant through a suit worn for protection in a superheated or toxic environment. In such a system, the canister would be carried by the wearer of the suit and be a part of a self-contained system in which the refrigerant functions both as a power source and as a heat sink. As heretofore proposed, prior art canisters are heavy and relatively inefficient in the facility with which heat is rejected to the dry ice. Heat transfer efficiency, moreover, declines precipitously as sublimation of the dry ice progresses so that the practically useful life of the system per each charge of dry ice is unexpectedly and unnecessarily short.

SUMMARY OF THE INVENTION

In accordance with the present invention, a canister holding a solid state refrigerant is made compactly of lightweight but strong materials, utilizing a principle of double wall construction. Between the walls, flow path means is defined through which a liquid coolant absorbing heat from a remote source is circulated. Secondary heat transfer material positioning in the flow path means assists in obtaining a high level of heat transfer efficiency through the inner canister wall. According to a feature of the invention, the flow path for the circulating liquid takes it in heat transfer relation to a bottom portion of the inner canister wall, assuring continuous maximal heat transfer throughout sublimation of the solid state refrigerant. The canister is fully selfcontaining and includes inlet and outlet fittings for the circulating liquid, an outlet fitting for gas released by the sublimation process and pressure relief means obviating a buildup of destructive pressure within the canister.

An object of the invention is to provide an integrated canister-heat exchange unit substantially in accordance with the foregoing.

Other objects and structural details of the invention will appear more clearly from the following description, when read in connection with the accompanying drawings, wherein.

Figure 4:
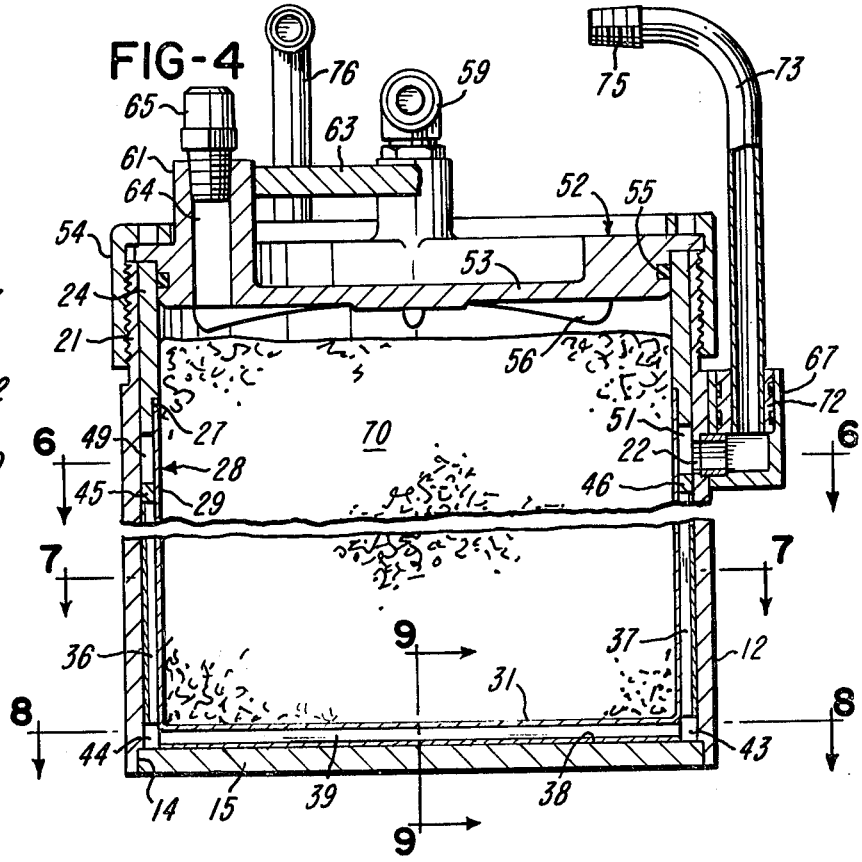
FIG. 4 is a view in longitudinal section taken substantially along the irregular line 4—4 of FIG. 2.
Figure 5:
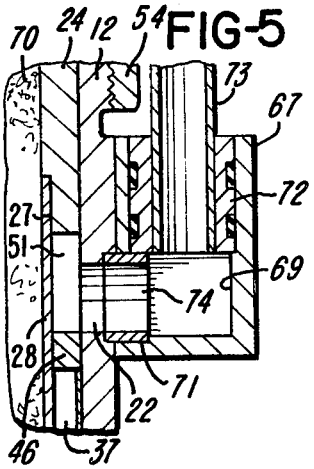
FIG. 5 is a detail enlarged view.

FIGS. 6, 7, 8, and 9 are views in cross section, taken substantially along respective lines 6—6, 7—7, 8—8 and 9—9 of FIG. 4;

FIG. 10 is a fragmentary detail view of an upper part of the unit, the outer canister container and an end closure therefor being omitted;

FIG. 11 is a view in cross section taken substantially along the line 11—11 of FIG. 10; and FIG. 12 is a detail view.

Referring to the drawings, a canister-heat exchange unit according to the illustrated embodiment of the invention comprises an outer canister container 11 which in part includes a side wall portion 12. The latter is made of an appropriate lightweight but strong material and is made to a cylindrical form with a longitudinal weld 13 extending the length thereof. At its one end, the wall 12 has an internal counterbore 14 in which is seated a plate 15. The plate 15 forms a bottom wall of the outer canister container and is appropriately secured in counterbore 14. On what may be regarded as an interiorly facing side of the plate 15 are integral raised portions 16 and 17, as seen particularly in FIG. 8. The raised portions 16 and 17 are relatively short arcuate segments of a circle and occupy diametrically opposite positions on the plate surface. Along an imaginary line drawn transversely through the plate 15 and centrally of the segments 16 and 17 are plate recesses 18 and 19. These position respectively between the arcuate segments 16 and 17 and the peripheral edge of the plate 15. They open through the interiorly facing surface of the plate.

Continuing to refer to the outer canister container, and particularly to wall portion 12 thereof, an extremity 21 of the wall portion 12 is reduced in diameter and externally threaded. In an adjacent relation to threaded extremity 21, in a direction toward bottom wall 15, are through bored apertures 22 and 23. These occupy a common transverse plane and in a circumferential sense are spaced apart about 45° to position on opposite sides of the above mentioned imaginary line occupied by the recesses 18 and 19 in plate 15.

Having a substantially press fit within what may be regarded as an upper or outer extremity of the outer canister container is a ring member 24. An outer end of the ring 24 coincides with the outer end of wall 12. An inner end of the ring terminates short of the through apertures 22 and 23. In the inner end of the ring is a pair of diametrically opposed slots 25 and 26 (see FIG. 11). The slots 25 and 26, one of which is of greater circumferential extent than the other, are in a plane coincident with the imaginary line intersecting recesses 18 and 19. The inner end of ring 24 still further is formed with an internal counterbore 27.

The canister unit further comprises an inner canister container 28 which includes a relatively lightweight cylindrical tube 29 forming a side wall portion. One end of the wall portion 29 is closed by a disc 31 forming a bottom wall portion of the inner canister container. Inner canister container 28 is telescopically received within outer canister container 11, bottom wall portion 31 thereof seating or substantially seating to arcuate segments 16 and 17 on bottom wall 15. An outer or upper end of the canister container is received in the counterbore 27 of ring 24, the arrangement being one to position and hold the inner container securely within the outer container and in a concentric, spaced relation thereto.

Further involved in a concentric positioning of the inner canister container is a pair of longitudinally elongated spacer members 32 and 33 which at what may be regarded as upper ends are received respectively in slots 25 and 26 in ring 24. The spacer members 32 and 33 extend longitudinally of the canister container unit to what may be regarded as the lower end thereof and have reduced diameter extremities positioning respectively in bottom plate recesses 18 and 19. In thickness, the spacer members 32 and 33 correspond approximately to the radial distance between the inner and outer containers. In extending between the ring 24 and bottom plate 15, and in effectively bridging the space between the inner and outer containers, the members 32 and 33 divide the annular space between the containers into semi-cyclindrical side spaces 34 and 35 (see FIG. 7). In space 34 is a fin strip 36 and in space 35 is a fin strip 37. In referring to a fin strip, it will be understood that there is identified a secondary heat transfer material in which a thin, ductile material having good heat transfer characteristics is crimped or gathered to a corrugated form and arranged to have at least one side thereof in contact with a heat conducting wall. Thus, a fluid flowing over or along the heat conducting wall is in simultaneous contact with the fin material which thus serves the purpose of providing secondary or extending heat transfer surface. In this instance, the fin strips are in a close intimately contacting relation to the outer surface of inner canister wall 29 and facilitate a conduction of heat through that wall. The fin material is flexible and is bent about an axis corresponding to the axis of the inner canister container to conform to the wall configuration 29. Side margins of the fin strips extend into substantially contacting relation to the members 32 and 33 on opposite sides thereof. At their one ends, the fin strips extend substantially to bottom wall portion 31 of the inner canister container. At their other or opposite ends the fin strips extend to a position just short of the transverse plane occupied by the bored apertures 22 and 23.

The spaces 34 and 35, separated at their sides by longitudinal members 32 and 33 are in communication at their lower ends through a passageway 38 defined between bottom wall 15 of the outer canister container and bottom wall portion 31 of the inner canister container. This passage is, moreover, occupied by a fin strip 39 peak portions of which are in heat conducting relation to a lower presented surface of bottom wall portion 31. The fin strip 39 has a disc-like configuration approximately matching that of bottom wall portion 31. It has peripheral cutout portions 41 and 42 which interfit with raised arcuate segments 16 and 17 whereby to position the fin strip in an angular sense. At opposite ends of the passageway 38 manifold chambers 43 and 44 are defined in which a flowing fluid may distribute itself respectively prior to entering the passageway and after leaving it.

Still further providing in the space between the inner and outer canister containers is a pair of orifice plate segments 45 and 46 (see FIG. 6). These are rib-like members which position in a transverse plane immediately adjacent to the transverse plane occupied by bored apertures 22 and 23 in a substantially contacting relation to the adjacent ends of fin strips 36 and 37. The orifice plate segments are arcuate in form and occupy segments of a circle adapted to bring their outer extremities into a substantially contacting relation to the longitudinal members 32 and 33 on opposite sides thereof. In the plate segment 45 is a circumferential series of slot-like apertures 47 and in the plate segment 46 is a similar series of like apertures 48. The construction and arrangement of parts is such as to define between orifice plate segment 45 and the adjacent end of ring 24 a manifold chamber 49 which at side extremities limit at the longitudinal spacer members 32 and 33. A like chamber 51 is defined between orifice plate segment 46 and the adjacent end of ring 24 and in similar manner side extremities of chamber 51 terminate at the longitudinal spacer members 32 and 33. The locations of the bored apertures 22 and 23 is such as to cause aperture 22 to communicate with what may be regarded as an inlet manifold 51 and to cause aperture 23 to communicate with what may be regarded as an outlet manifold 49. Completing the canisterheat exchange unit is a closure assembly for the upper end of the outer container 11. This assembly includes a closure cap 52 which seats on the upper end of container 11 and has a reduced diameter cylindrical portion 53 received in the open upper end of the outer container. A retainer member 54 is superimposed over the closure cap 52 in a following relation thereto and has a flanged extremity in screw threaded engagement with the externally threaded extremity 21 of the canister wall 12. Obviously, the retainer member 54 clamps cap 52 into a seated, closing relation to the open end of the outer container. A peripheral seal 55 is in the reduced diameter portion 53 of closure cap 52 and obviates an escape of fluid from the canister interior around the closure cap. On an inwardly facing side of the closure cap 52 is a projecting arrangement of ribs 56 serving a purpose as will hereinafter more clearly appear in obviating obstruction of gas outlets by a contained solid state refrigerant.

Figure 1:
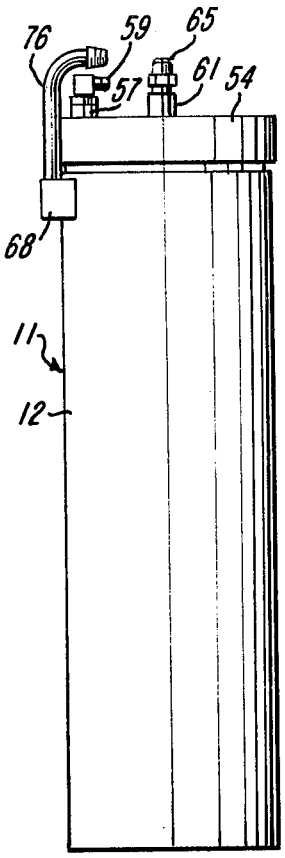
FIG. 1 is a view in side elevation of a canister-heat exchange unit in accordance with the illustrated embodiment of the invention.
Figure 2:
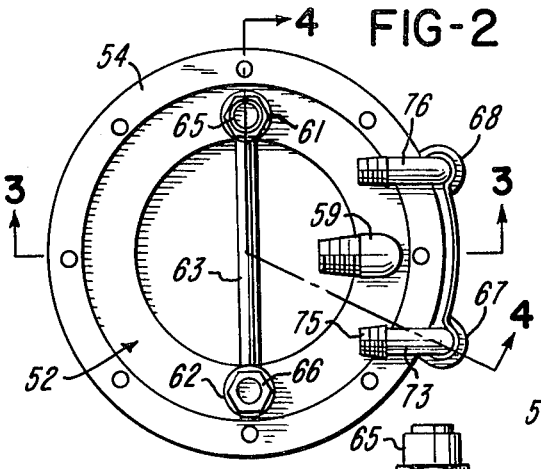
FIG. 2 is a top plan view of the unit of FIG. 1.
Figure 3:
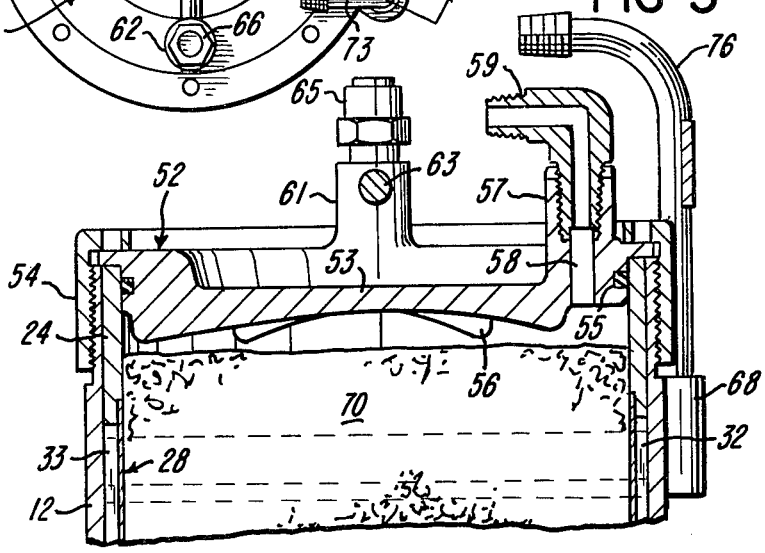
FIG. 3 is a fragmentary view in longitudinal section of an upper part of the unit, taken substantially along the line 3—3 of FIG. 2.

Formed integrally with the closure cap 52 is a plurality of upstanding bosses, including a boss 57 (FIG. 3) defining an interior passage 58 communicating at its inner end with an interior canister space as defined by the inner canister container 28 and as closed by cap 52. A fitting 59 is installed in boss 57 and provides a connection by which gases forming in the canister may be conducted therefrom. Other bosses 61 and 62 are interconnected by a bridging portion 63 providing a handle by which the canister unit may be lifted and carried about. The boss 61 has a longitudinally through bore 64 which at its inner end opens into the canister interior. Installed in the outer end of passage 64 is a fitting 65 embodying a pressure relief valve (not shown in detail). In a similar manner not specifically illustrated, boss 62 has a through bore or passage communicating at an inner end with the canister interior. Installed in the outer end of boss 62 is a fitting 66 embodying a pressure rupturable disc (not here shown in detail).

Completing the canister-heat exchange unit is structure to bring a fluid such as a liquid coolant to the unit for circulation through the flow passages defined by inner and outer canister containers 11 and 28 and for conducting the circulating fluid therefrom. Bodies 67 and 68 are fixed to the exterior of outer canister container wall 12 in positions respectively covering bored apertures 22 and 23. The bodies 67 and 68 are substantially identical so that a description of one will suffice for both. Thus, body 67 has a vertical bore 69 from an inner end of which opens a lateral port 71. In mounting the body to the canister wall it is oriented so that bore 69 opens upwardly of the body and port 71 aligns with all aperture 22. It accordingly directly communicates with arcuate manifold chamber 51. Bore 69 relatively rotatably receives a cylindrical enlargement 72 fixed to an inner end of a tube 73. Peripheral sealing means are recessed into the exterior of cylindrical member 72 in a manner to inhibit an escape of fluid therearound while permitting a relative swiveling movement of the cylindrical member and of the tube 73 of which it is a part. An inserted ferrule 74 limits inward movement of enlargement 73. The tube 73 is open throughout its length and projects upwardly from body 67. An upper end orients in the same general area as fittings 59, 61 and 62 above closure cap 52 and has a bent configuration. An upper end is formed with an adapter 75 by which the tube may be connected in a circulating fluid system. A tube 76 is similarly installed in body 68 and is similarly positioned and constructed for connection in a circulating fluid system.

In an application to which the canister-heat exchange unit is adapted, inner container 28 is filled or substantially filled with a solid refrigerant, for example dry ice in the form of a log 70. The rib formation 56 obviates entrance of the dry ice into gas excape passage 58 and other closure cap passages communicating with the canister interior. The tubes 73 and 76 are connected in a system circulating a liquid coolant, as for example a suit worn for protection in a hostile environment. At the suit, or other place of use, the liquid coolant absorbs heat. Directed from the place of use to the canister-heat exchange unit, the heated coolant reaches the unit by way of tube 73 or 76, according to a selection and identification of these tubes as inlet and outlet tubes. Assuming the heated coolant to have reached the canister-heat exchange unit by way of tube 73, it is directed thereby to body 67 and through port 71 and aligning aperture 22 into manifold chamber 51. There the coolant encounters orifice plate segment 46 and is compelled thereby to distribute itself within the arcuate chamber between spacer members 32 and 33. By way of slots 48, the coolant is allowed to descend through plate segment 46 and it flows downwardly toward the bottom of the container unit in common contact with the exterior of inner canister container 29 and with the fin strip 37 positioning between the inner and outer canister containers. Reaching manifold 43, the liquid coolant crosses the bottom of the canister, flowing through passageway 38 in common contact with the underside of wall portion 31 and fin strip 39. At manifold 44 the coolant turns upwardly again and flows along fin strip 36 in contact with an opposite side wall of the inner container. Plate segment 45 insures that this upward flow is a well distributed flow throughout the space defined by the spacer members 32 and 33. At member 45, the coolant rises through slots 47 and enters manifold chamber 49. There is has access through bored aperture 23 to body 68 and to communicating tube 76. From tube 76, the coolant returns to the place of use for recirculation.

By a convection-conduction process, the liquid coolant in flowing through the canister-heat exchange unit rejects heat to the contained solid refrigerant. The latter vaporizes and in a sublimation process gives off a gas which is allowed to escape from the container by way of passage 58. Fitting 59 may be connected to a pump circulating the liquid coolant for a fully self-contained system. The solid refrigerant serves under these conditions as a combination power source and heat sink. In the event the escaping gas is not properly used or vented the relief valve 65 functions to allow venting of the created gas at a predetermined high pressure level. Should failure of relief valve 65 occur, rupture disc means in fitting 66 provides a further factor of safety in avoiding a buildup of destructive pressures within the container.

According to a feature of the invention, heat is rejected to the contained refrigerant not only through side wall 29 of inner canister container 28 but also through bottom wall portion 31. In the course of system operation of predetermined duration, of the kind to which the unit is adapted, physical shrinking of the contained solid refrigerant occurs, it being obvious that this will occur principally at places of contact of the refrigerant with the inner container. Gas filled gaps appear between the refrigerant and the inner container wall substantially reducing the efficiency with which heat is rejected through the container wall to the refrigerant. At the bottom of the container, howerer, forces of gravity keep the solid refrigerant constantly in contact with bottom wall portion 31. In this portion of the system, therefore, there is continuously good heat transfer through the canister wall into the contained refrigerant. In this connection, fin material 39 may be used which is structured and oriented to bring about turbulizing effects along with accompanying good flow distribution thereby assuring high performance heat rejection. In the present instance, as shown in FIG. 8, the fin strip is a stripped or lanced material such that the corrugations are not continuous and in line but rather are formed of discontinuous offset sections. Moreover, the strip orients with respect to the direction of flow of the liquid coolant through passageway 38 in such manner that the coolant is required to flow transversely of the corrugations rather than longitudinally thereof. This has an effect, as before noted, of increased turbulence and more thorough and extensive contact of the liquid coolant with both involved primary and secondary surfaces. A high level of heat transfer effectiveness is continuous at bottom wall 31 throughout a period of use of the canister-heat exchange unit. Fin strips 36 and 37 may be constructed like the fin strip 39 and may be similarly oriented for flow transversely of the corrugations. In the illustrated instance, while the fin strips 36 and 37 have a lanced or stripped construction they are positioned for flow lengthwise of their corrugations.

The mode of assembly of the unit will be largely selfevident from the drawings and description. It can be noted, however, that the assembly comprising the inner canister container and the related parts lends itself to organization as a subassembly and may in this form be introduced into the outer container, the parts being lightly attached to one another. Inner canister container, the fin stips 36, 37 and 38, the spacer members 32 and 33, ring 24, including plate 15, orifice plate segments 45 and 46 and body members 67 and 68 make up a unitary brazement. These parts are assembled and appropriately held in a fixture, and, in the presence of suitably inserted braze alloy, are heated to a brazing temperature and then cooled. The parts are in this manner joined together in a unitary assembly. In the process, corrugations of the fin strips 36, 37 and 38 are bonded directly to the inner canister container and assure a good conduct of heat therebetween.

The invention has been disclosed with respect to a particular embodiment. Structural modifications have been discussed and these and others obvious to a person skilled in the art to which this invention relates are considered to be within the intent and scope of the invention.

What is claimed is:

1. An integrated refrigerant storage canister and heat exchanger, especially a device which in use occupies a generally upright position including a. an assembly comprising nested inner and outer containers, the former being adapted to contain a solid state refrigerant sublimated by a transfer of heat through defining wall portions of said inner container into the refrigerant, b. said inner container having a closed bottom wall portion in supporting relation to a contained refrigerant material, c. means for conducting released gas from said inner container, d. means for conducting a circulating fluid absorbing heat at a relatively remote source to and from said assembly, e. and means for conducting the circulating fluid through said assembly by way of a path requiring it to pass between said containers in heat transfer relation to said bottom wall portion of said inner container, f. side and bottom wall portions of said inner and outer containers being in a spaced relation to one another, g. separators positioning longitudinally within the space between side wall portions and defining vertical flow passes interconnected at their lower ends by a space between bottom wall portions defining a horizontal flow pass, h. there being connections to and from upper ends of respective vertical flow passes for inflow and outflow of said fluid, i. and said connections and said separators cooperating to require a path of flow for said fluid taking it downward in one of said vertical flow passes, transversely through said horizontal flow pass and upwardly in the other of said vertical flow passes.

2. A device according to claim 1, wherein a. means positions to close upper ends of said containers, b. and segmental orifice plate segments position in said vertical flow passes to form above them manifold inlet and outlet chambers, c. said segments positioned to opposite sides of said separators.

3. A device according to claim 2 wherein a. said vertical flow spaces are each occupied by a secondary surface heat transfer material, said material being in each instance flexible fin means extending at upper and lower ends between a respective orifice plate segment and a lower end of a respective vertical flow pass, b. said flexible fin means being in a wrapping relation to said inner container and extending at side margins into an approaching substantially contacting relation to said separators.

4. A device according to claim 3, wherein a. meas positively define the spaced relation between bottom wall portions of said inner and outer containers, b. and secondary surface heat transfer fin material is installed in said horizontal flow pass.

5. A device according to claim 4, wherein a. said fin material in said horizontal flow pass is united to the bottom wall of said inner container b. and said fin material in said side spaces is united with an outer wall of said inner container, c. said fin material in said horizontal flow pass and the fin material in said vertical flow passes being fixed thereby in relative orientation.

6. A device according to claim 2, wherein a. said vertical flow passes below said plate segments and said horizontal flow pass being occupied by secondary heat transfer surface material, b. the material in said horizontal flow pass positioning to define manifold chambers at opposite ends of said horizontal flow pass.

7. A device according to claim 6, wherein a. the secondary heat transfer surface material in at least said horizontal flow pass is a lanced corrugated fin material orienting so that fin corrugations position transversely of the direction of fluid flow through said horizontal flow pass.

8. A device according to claim 1, wherein a. said means positioning to close upper ends of said containers includes a closure cap embodying said means for conducting released gas and embodying means for limiting gas pressure in said inner container to a predetermined high value, b. said device acting as a container, as a heat exchanger and as a power generator.

9. A device according to claim 1, wherein a. means positions to close upper ends of said vertical flow passes, b. said separators projecting upward to engage said closing means, c. and said connections to and from upper ends of respective vertical flow passes opening through said outer container into respective vertical flow passes beneath and adjacent to said closing means.

10. A device according to claim 9, wherein a. segmental orifice plate segments position in said vertical flow passes beneath and in spaced relation to said closing means and have ends engaging said separators, b. said segments cooperating with said separators and with said containers and said closing means to define above them inlet and outlet manifold chambers, said connections to and from upper ends of respective vertical flow passes opening into respective manifold chambers.

* * * * *